United States Patent [19]

Miller et al.

[11] Patent Number: 4,724,071

[45] Date of Patent: Feb. 9, 1988

[54] SELECTIVE RESIN FLOTATION FROM COAL BY CONTROLLED OXIDATION

[75] Inventors: Jan D. Miller; Ye Yi, both of Salt Lake City, Utah

[73] Assignee: University of Utah, Salt Lake City, Utah

[21] Appl. No.: 920,125

[22] Filed: Oct. 17, 1986

[51] Int. Cl.[4] ..... B03D 1/02

[52] U.S. Cl. ..... 209/167

[58] Field of Search ..... 209/166, 167; 252/61

[56] References Cited

U.S. PATENT DOCUMENTS

| | | | |
|---|---|---|---|
| 1,773,997 | 8/1930 | Green | 209/166 |
| 1,869,532 | 8/1932 | Weinig | 209/167 |
| 2,506,301 | 5/1950 | Klepetko | 209/166 |
| 2,591,830 | 4/1952 | Klepetko | 209/166 |
| 3,655,038 | 4/1972 | Mercade | 209/166 |
| 4,377,473 | 3/1983 | Laros | 209/167 |
| 4,537,599 | 8/1985 | Greenwald, Sr. | 44/1 SR |
| 4,543,104 | 9/1985 | Brown, Jr. et al. | 44/1 SR |

FOREIGN PATENT DOCUMENTS

| | | | |
|---|---|---|---|
| 716609 | 2/1980 | U.S.S.R. | 209/167 |

OTHER PUBLICATIONS

"Recovery of Resin from Utah Coal", by E. Klepetko, AIMME Tech. Publication, 2166 ©1947.

Hackh's Chemical Dictionary, 4th Edition, McGraw-Hill, pp. 484 and 502.

*Primary Examiner*—S. Leon Bashore

*Assistant Examiner*—Thomas M. Lithgow

*Attorney, Agent, or Firm*—Trask, Britt & Rossa

[57] ABSTRACT

Disclosed is a process for separating resin from reduced size resin-bearing coal particles by treating the particles with ozone. Particles of reduced size resin-bearing coal are preferably mixed with water to form a slurry. The slurry is then treated with ozone for a short length of time. The slurry is then subjected to froth flotation. The ozone selectively oxidizes the coal, decreasing its hydrophobicity causing the relatively more hydrophobic resin to attach to the bubbles formed during the flotation process. A much improved separation efficiency for resin flotation from coal is observed.

18 Claims, 3 Drawing Figures

SELECTIVE RESIN FLOTATION FROM COAL BY CONTROLLED OXIDATION

BACKGROUND OF THE INVENTION

1. Field This invention relates to a method for treating coal, and more particularly to a method for separating resin from coal by froth flotation.

2. State of the Art Using froth flotation to remove and separate natural resins ("resins") from resin-bearing coal is well known. U.S. Pat. No. 1,773,997 (Green) is illustrative of the process. Resin-bearing coal is comminuted in the presence of two parts of water and passed through a 40 mesh screen. Another part of water is added, and the resulting pulp is introduced into a froth flotation machine. A frothing agent, such as amyl alcohol, is added to the pulp, and the mixture agitated. A froth forms which carries with it a certain portion of any present resin while the coal-predominant tailing remains.

The resultant resin-bearing froth is then retreated. The resinous froth is reintroduced into the flotation machine, water is added to fill the machine to a working level, and substances such as potassium alum, may be added. The resulting mixture is then agitated. More frothing agent is introduced, and a resin froth is taken from the flotation machine. Green reported that relatively pure (approaching 96% by weight) resin can be attained using the above two-step method.

Extracting resin from resin-bearing coal is particularly important in Western North America. There, certain coal fields contain significant quantities of resins. Other areas of the world known to have resin-bearing coal are Mainland China and Argentina.

The State of Utah has significant amounts of resin-bearing coal in its coal fields. The resins obtained from Utah coal generally have low specific gravities, approximately 1.03 g/cm$^3$, and vary in color from lemon yellow to almost black. The resins are important commercially, being used for adhesives, varnishes, coatings, waterproofing, linoleum, etc., and generally command a substantially higher price per pound than coal. This resinous coal also has a significantly lower sulfur and ash content than coal obtained elsewhere, for example, coal from the eastern United States.

Prior art flotation techniques for resin recovery have not, however, been particularly selective. Both components of the feed, resin and coal, have similar hydrophobic characteristics as shown by the contact angle and bubble attachment time data listed in Table 1. The difference between the bubble attachment times for resin and coal is insufficient to achieve the desired selective flotation separation by conventional flotation techniques.

The hydrophobic character of resin and coal from the Hiawatha, Utah seam is shown in Table 1. The bubble attachment time is measured as the bed induction time with particle size 212×300 microns at a pH of 6.5.

TABLE 1

| Component | Contact Angle Degrees | Bubble Attachment Time (ms) |
|---|---|---|
| Resin | 58–59 | 5 |
| Coal | 48–51 | 15 |

Some work has been done by others, U.S. Pat. Nos. 4,537,599 (Greenwald) and 4,543,104 (Brown), in treating coal with ozone during froth flotation to remove unwanted coal contaminants such as ash and sulfur. Brown teaches the treatment of coal with ozone for a period of five to twenty minutes, and preferably at least ten minutes, to obtain a very hydrophobic coal which floats, leaving ash behind as part of the gangue.

Greenwald also teaches the use of ozone in froth flotation to separate coal from the contaminants pyrite and clay. Greenwald also seeks very hydrophobic coal and his process leaves the contaminants behind as gangue. Since the hydrophobic characteristics of coal and resin are so similar, treating resin-bearing coal in the manner of Greenwald or Brown yields no separation of the resin particles from the coal particles. The present invention overcomes the insufficiencies of the prior art froth flotation techniques to yield effective separation of coal particles from resin particles.

SUMMARY OF THE INVENTION

Resin-bearing coal is reduced in size to a particle size of no more than 10 mesh. This reduced sized resin-bearing coal has a substantial quantity of resin-rich particles with most of the particles being coal-rich. These particles, if not wet ground initially, are then mixed with water so as to form a mixture of about 10% to 50% by weight particles. For a short duration, usually less than 90 seconds, the particle-water mixture is treated with ozone at the level of 100 mg of ozone per kilogram of particles to 450 mg of ozone per kilogram of particles. Subjecting the ozone treated mixture to flotation with distinct frothing agents enables substantially all of the resin-rich particles to be removed in the froth from a single pass through a conventional flotation machine, while the coal-rich particles portion of the mixture remains as a gangue or tailing.

DESCRIPTION OF THE PREFERRED EMBODIMENT

This invention involves treating a mixture of resin and coal particles with ozone either before or during flotation in order to separate selectively the resinous portion from the coal containing portion.

Initially, the resin and coal particles must be reduced to a floatable size. In order for froth flotation to work on coal particles, the particles must generally be no greater than 10 mesh in size, but about 100 micron particles or finer are preferred for use in this invention. The finer the particles used, the more optimal the end results will be. It is to be understood that all references in this disclosure to "mesh" are to Tyler mesh.

Particle size reduction, while being essential to froth flotation, may also help to explain the excellent results obtained by the instant process. A large particle of resin-bearing coal has resinous portions embedded into the predominantly coal-containing particle. When the large particle of resin-bearing coal is comminuted into multiple smaller particles, some of the resulting smaller particles will have a surface area comprised mostly of resin (i.e., "resin-rich particles"). The resin-rich particles are therefore a small portion of the total particles present in the froth flotation process. It is usually more efficient in a flotation process to remove the minor phase with the froth and leave the predominant phase (i.e., the predominantly coal-containing particles) behind with the gangue.

As soon as feasibly possible after the particle size reduction has taken place, the freshly fragmented particles are mixed with water to form a particle-water slurry. Concentrations of 10% to 50% by weight resinous coal may be used, although the percent solids is not particularly critical mainly influencing the ozone demand of the system. The higher concentration ranges are preferred. To get optimal results, the treatment should occur immediately after the particle size reduction step.

Figure 1:
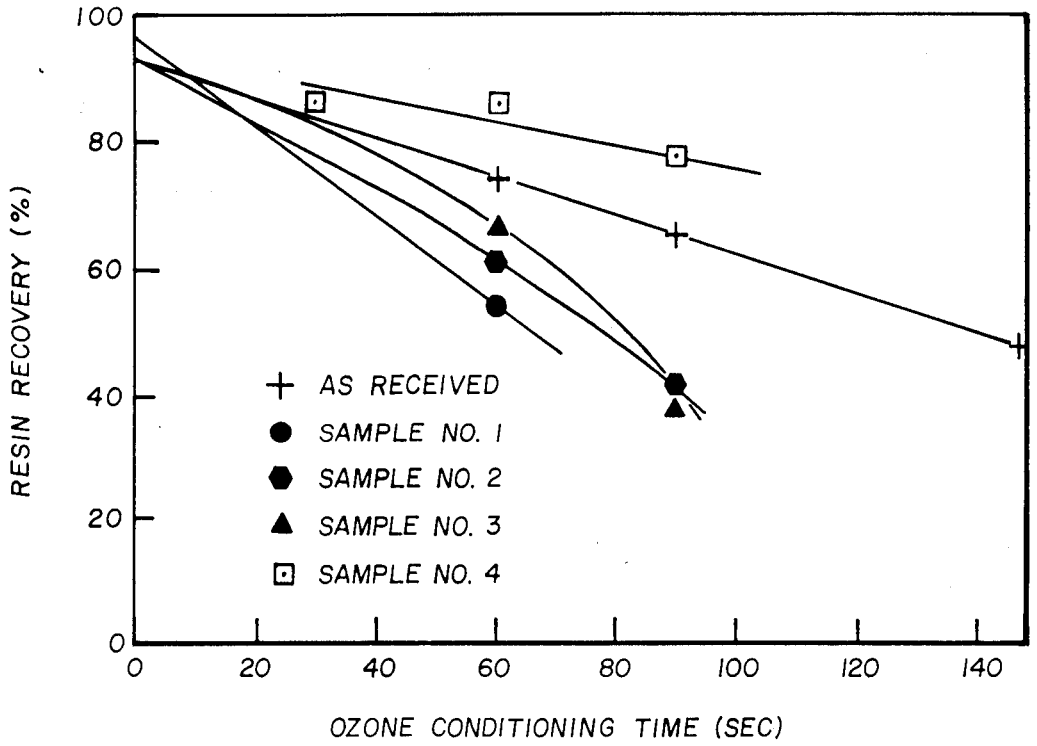
FIG. 1 is a graph depicting the total percentage quantity of resin recovered from the particle water slurry as a function of ozone treatment time in seconds. (Sample No. 1 was wet ground for one minute, Sample No. 2 was wet ground for five minutes, Sample No. 3 was wet ground for fifteen minutes, and Sample No. 4 was wet ground for 30 minutes.)

Conditioning or treatment with ozone then occurs. Ozone is sparged through the particle-water slurry. The level of addition of the ozone varies from about 100 mg per kilogram of particles to about 450 mg per kilogram of minute particles. The treatment time should be less than about 90 seconds since with longer treatment times, the resin's hydrophobicity also decreases, and no separation of particles occurs, as shown in FIG. 1. FIG. 1 depicts the total quantitative resin recovery from the particle water slurry as a function of time. With no ozone treatment, nearly 100% of the total resin in the particle slurry attaches to the froth bubbles and floats. However, little selectivity is shown for resin particles over coal particles with no ozone treatment and hence the process is undesirable. As the ozone conditioning time increases, the total amount of resin recoverable from the particle-water slurry decreases slightly, but selectivity for resin attachment to the froth bubbles increases dramatically. If the slurry is treated with ozone for greater than about 90 seconds, the resin's hydrophobicity decreases to the point where resin remains suspended in the water together with the coal particles. The treatment time and the quantity of ozone used are inversely related, i.e., when less ozone is used, the required treatment time increases.

The treatment with ozone can occur at any time before or during the actual froth flotation separation. In one alternative embodiment, the particles are treated with ozone during the particle size reduction step. In another alternative embodiment, the particles are treated with ozone during the actual flotation step by using water already saturated with ozone. Although the particles can be treated with ozone in a dry state, e.g., a fluidized bed or static bed, sparging gaseous ozone in a water-particle slurry is preferred.

Ozone can be generated using methods generally known in the art. Such methods include high voltage corona contact with air, electrolyzing dilute sulfuric acid, and through the use of ultraviolet light.

After treatment with ozone, the particle-water slurry is introduced into a standard flotation machine. Generally, a 10% by weight particle concentration works best for froth flotation of resin, so more water is added if necessary. A frothing agent such as methyl isobutyl carbinol (MIBC), pine oil (actually an alcohol), or Dow Froth TM (a polyglycol-type frothing agent) is added. Flotation is then carried out.

As a result of the above procedures, the resin particles are separated from the predominantly coal-containing particles. Through ozone conditioning, the resulting resinous particles are significantly more hydrophobic than the predominantly coal-containing particles and preferentially attach to the bubbles formed during the froth flotation process. The resinous particles rise with the bubbles to form part of the froth, while the coal particles remain suspended in the water together with the mineral matter impurities.

The resin is then separated from the froth using techniques known to those skilled in the art (e.g., filtration, drying, or solvent extraction). A resin of greater than 95% purity is obtainable with a 60–80% total recovery of the original feed in a single stage of flotation. Of course, multiple flotation steps can be performed to achieve even better separations.

Specific examples of the use of the invention follow.

EXAMPLE

Four samples with different particle size distributions (see Table 2) were prepared for the flotation experiments. These samples were prepared by grinding a thickener underflow slurry for varying lengths of time at about 50% solids. Sample No. 1 was wet ground for one minute, Sample No. 2 was wet ground for five minutes, Sample No. 3 was wet ground for fifteen minutes, and Sample No. 4 was wet ground for thirty minutes. The slurry was procured from the U.S. Fuels preparation plant at Hiawatha, Utah, which cleans the resinous Hiawatha-seam coal and discards the fines. The average resin content of these samples is 7.2%. In other bubble attachment-time experiments, particles of coal and resin were hand-picked from large chunks of ROM Hiawatha coal and dry-ground separately with a porcelain pestle. Particles with a size of 212×300 microns were obtained by dry-screening and stored in a refrigerator before the experiments in order to avoid a change in the surface properties.

TABLE 2

Size Analysis of Resinous Hiawatha Coal Used in Flotation

| Size (mesh) | Samples #1 | #2 | #3 | #4 |
|---|---|---|---|---|
| +50 | 6.64 | 3.22 | 0.60 | 0.10 |
| 50/70 | 13.06 | 4.78 | 2.32 | 0.87 |
| 70/100 | 10.93 | 4.98 | 3.43 | 1.06 |
| 100/140 | 16.36 | 14.70 | 6.71 | 4.27 |
| 140/200 | 8.20 | 9.94 | 8.04 | 5.12 |
| 200/325 | 5.27 | 13.27 | 14.85 | 11.62 |
| 325/400 | 9.24 | 13.56 | 19.68 | 14.55 |
| −400 | 30.30 | 35.76 | 44.37 | 62.41 |
| Head | 100 | 100 | 100 | 100 |

Resin Distribution in Sample 1

| Size (mesh) | Resin Distribution (%) |
|---|---|
| +20 | — |
| 20/100 | 42.69 |

TABLE 2-continued

| | |
|---|---|
| 100/200 | 18.06 |
| 200/400 | 17.73 |
| −400 | 21.52 |
| Head | 100 |

Bubble attachment times (i.e., induction times) for resin and coal particles with and without ozone treatment were measured with an Electronic Induction Timer, a product of Virginia Coal and Mineral Service, Inc. The results reported for such measurements represent a statistical average of at least 100 measurements for each point. Measurements were carried out at pH 6.5, although the process appears independent of pH. Pretreatment of resin and coal suspensions by ozone gas before bubble attachment-time measurements was carried out in a one liter beaker by introducing ozone gas into the suspension while gently stirring. The mass flow rate of ozone into the suspension was 0.18 grams per minute (g/min).

Flotation experiments were conducted with a three liter Galigher flotation machine at 10% solids concentration. Commercial methyl isobutyl carbinol (MIBC) was used as a frothing agent in a concentration of 0.03 kg/ton for both common flotation and ozone-pretreatment flotation. No promoter was added in the flotation. In the ozone-pretreatment flotation, the air inlet on the flotation machine was first connected to the outlet of an electrical ozone generator. The ozone with oxygen as a parent gas was introduced into resin/coal slurry through the air inlet and sparged naturally while stirring the slurry. The ozone was added at a rate of 0.18 g/min and for a conditioning time of from 30 to 90 seconds. After conditioning, MIBC was added and flotation was carried out for 5 minutes at 900 rpm with an air flow rate of 4 liters per minute. All flotation tests were run at ambient temperature.

Feed and tailing samples were analyzed for resin content by solvent extraction in a Soxhlet apparatus using hexane as the solvent. The resin content of the concentrate fraction was calculated from the feed and tailings samples by mass balance.

It was discovered that conditioning of the resin/coal slurry for about one minute with ozone at a flow rate of 0.18 g/min resulted in a strong oxidation of the coal surface and the creation of a highly hydrophilic state which facilitated the selective flotation/separation of resin from coal.

Figure 2:
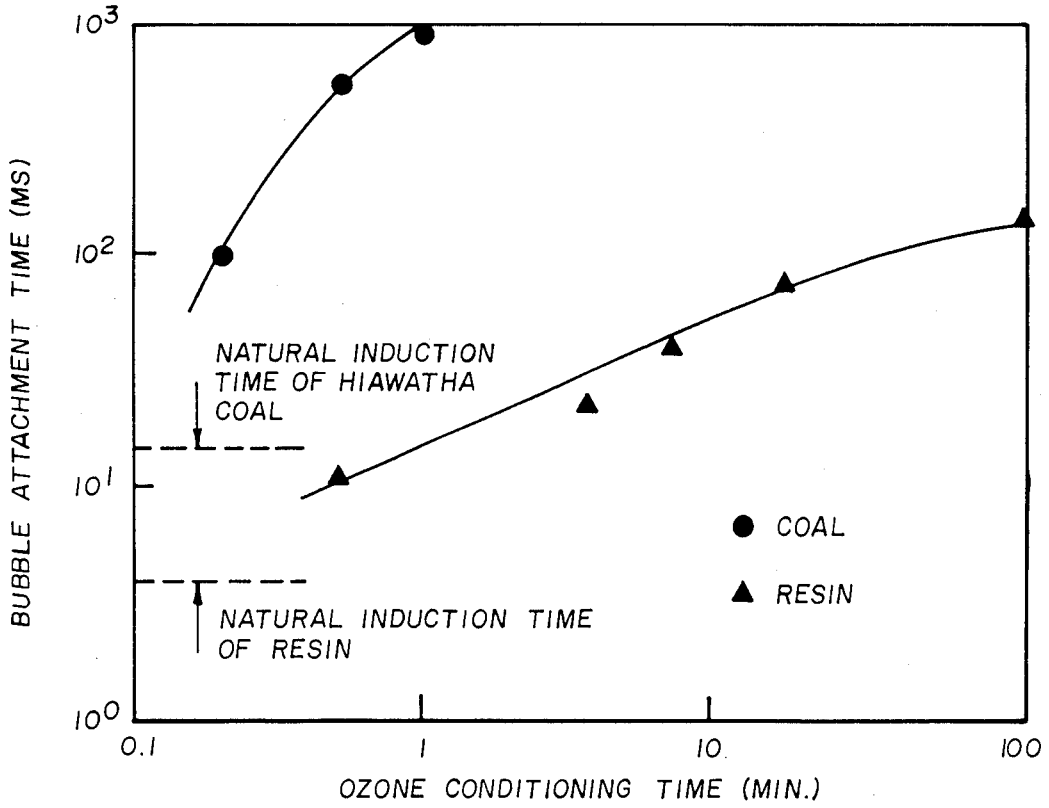
FIG. 2 is a graph depicting the bubble attachment time of resin and Hiawatha (Utah) coal as a function of ozone conditioning time (pH=6.5, particle size=212×300 microns, ozone flow rate is 0.18 grams/minute)

The effect of ozone conditioning is most evident from the bubble attachment-time data shown in FIG. 2, in which bubble attachment time is plotted as a function of ozone-pretreatment time. In this experiment, ozone was introduced into the bottom of a beaker containing a resin/coal slurry at a mass flow rate of 0.18 g/min and sparged, as described above. After pretreatment, the pH of the suspension was adjusted to pH 6.5 and the samples were transferred promptly into the induction-timer cell to measure the bubble attachment time. The ratio of bubble attachment times (coal/resin) increased from about three with no exposure to ozone to about 67 with ozone conditioning of one minute. The relative difference in hydrophobicity increased by at least one order of magnitude, and selective flotation of resin from coal is expected under these conditions.

Figure 3:
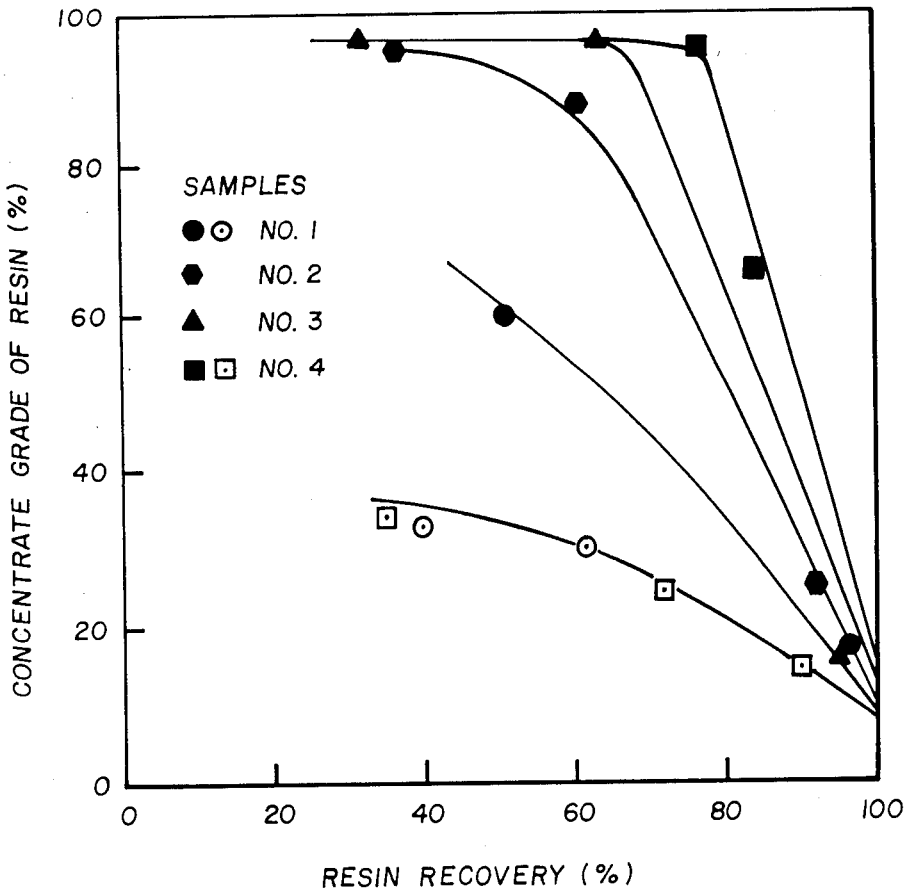
FIG. 3 is a graph depicting the grade/recovery curve in which the quality of the product (percent resin in the concentrate) is plotted against the recovery of the resin from the feed (10% solids in 3 liter flotation machine; 0.03 kilograms per ton methyl isobutyl carbinol; ozone pretreatment of 30–90 seconds at a flow rate of 0.18 grams per minute into slurry through air inlet; open symbols depict no ozone pretreatment. Sample No. 1 was wet ground for one minute, Sample No. 2 was wet ground for five minutes, Sample No. 3 was wet ground for fifteen minutes, and Sample No. 4 was wet ground for thirty minutes).

The selective flotation separation was improved significantly, as shown by FIG. 3, where the grade/recovery curves for resin flotation by ozone conditioning are compared to the curve for flotation without the ozone conditioning (e.g., as taught by Green, U.S. Pat. No. 1,773,997). In these experiments, the samples were identical. They were obtained by cutting a wet filter cake of the resinous coal feed into several pieces after grinding and filtration. Flotation conditions were maintained constant. The manner of the ozone-gas conditioning was as described above. Conditioning time was controlled at 30 to 90 seconds, depending upon the desired grade and recovery. Flotation time was maintained at five minutes for all ozone-conditioning experiments. Flotation time for experiments without ozone varied from three to ten minutes, again depending on the desired grade and recovery. The improvement in separation efficiency is reached with the ozone-pretreatment such that a resin concentrate containing greater than 95% resin can be obtained at 60% to 80% recovery in a single-stage flotation, as compared to a product containing only 40% resin using Green's technique in a single-stage flotation. These results reveal that the desired separation of resin from coal can be achieved by adding ozone into the froth flotation system.

Due to the manner of ozone conditioning, most of the ozone introduced into the slurry was lost before it reacted with the coal particles or dissolved into the slurry during the short conditioning time. The actual quantity of ozone reacting with coal particles or dissolved into the slurry would therefore be substantially less than that which was actually introduced. It is evident that the conditioning time with ozone is strongly dependent upon the concentration of the ozone and the flow rate of the ozone/oxygen mixture.

Treating the mixture of resin and coal particles with ozone as described in the above example for greater than about 90 seconds yields less efficient separation of the particles. This phenomenon is probably due to excessive oxidization of the resinous particles resulting in a more hydrophilic surface and therefore a poor flotation response. Thus, using Greenwald's or Brown's techniques where the coal is treated for approximately five to twenty minutes, both the coal particles and the resin particles are depressed and the separation is ineffective.

Although the invention has been shown in connection with a specific embodiment, those skilled in the art will recognize that many variations of this invention are possible without departing from the spirit or scope of the invention.

We claim:

1. A method for separating resin from minute particles of resin-bearing coal, wherein at least some of said minute particles have a significant resinous portion, and are of a size suitable for forming a slurry with water, comprising: adding water to said minute particles so as to form a minute particle-water slurry;

treating the minute particle-water slurry with ozone for a sufficient amount of time to increase the difference in hydrophobicities of the resin and coal particles;

adding a suitable frothing agent to the minute particle-water slurry; and frothing the minute particle-water slurry so as to form bubbles which attach to the resinous portion of the minute particles containing a resinous portion and transport said resinous portion to a froth which floats on the water.

2. The method of claim 1 wherein said minute particles of resin-bearing coal are of a size no greater than 10 mesh.

3. The method of claim 2, wherein the minute particle-water slurry is from about ten percent (10%) to about fifty percent (50%) by weight minute particles.

4. The method of claim 3 wherein the minute particle-water slurry is about thirty percent (30%) by weight minute particles.

5. The method of claim 4 wherein the ozone used in treating the minute particle-water slurry is used in a concentration of at least about 100 mg per kilogram of minute particles.

6. The method of claim 5 wherein the minute particle-water slurry is treated with ozone for less than 90 seconds.

7. The method of claim 6 including the steps of removing the froth from the water, and extracting the resinous portion from the froth.

8. The method of claim 7 wherein said frothing agent is methyl isobutyl carbinol.

9. The method of claim 8 wherein the particle size of the minute particles is 28 mesh or less.

10. The method of claim 1 wherein said ozone is introduced to the minute particles before or during the flotation step.

11. The method of claim 9 wherein said ozone is produce high voltage corona contact with air.

12. The method of claim 8 wherein the particle size of the minute particles less than about 150 microns.

13. The method of claim 9 wherein said ozone is produced by electrolyzing dilute sulfuric acid which has been added to the minute particle-water slurry.

14. The method of claim 10 wherein said ozone is produced by a photochemical reaction using ultraviolet light.

15. The method of claim 1 wherein said minute particles are produced by reducing larger particle size resin-bearing coal.

16. The method of claim 15 wherein said ozone is introduced to the minute particles during the reduction of the larger particle size resin-bearing coal.

17. The method of claim 15 wherein said ozone is introduced to the minute particles immediately after the reduction of the larger particle size resin bearing coal.

18. A method for separating resin from minute particles of resin-bearing coal, wherein at least some of said minute particles are resin-rich and other particles are coal-rich, said coal particles being of a size suitable for forming a slurry with water, comprising:

adding water to said minute particles so as to form a minute particle-water slurry;

treating the minute particle-water slurry with ozone for a sufficient amount of time to increase the difference in hydrophobicities of the resin and coal particles;

adding a suitable frothing agent to the minute particle-water slurry;

frothing the minute particle-water slurry in a frothing apparatus;

recovering the resin-rich particles from the top overflow of said frothing apparatus; and recovering the coal-rich particles from the bottom and flow of such apparatus.

* * * * *

UNITED STATES PATENT OFFICE
CERTIFICATE OF CORRECTION

Patent No. 4,724,071 Dated February 9, 1988

Inventor(s) Jan D. Miller, Ye Yi

It is certified that error appears in the above-identified patent and that said Letters Patent are hereby corrected as shown below:

In the drawings insert as sheet 1 FIGS. 1 and 2 as follows:

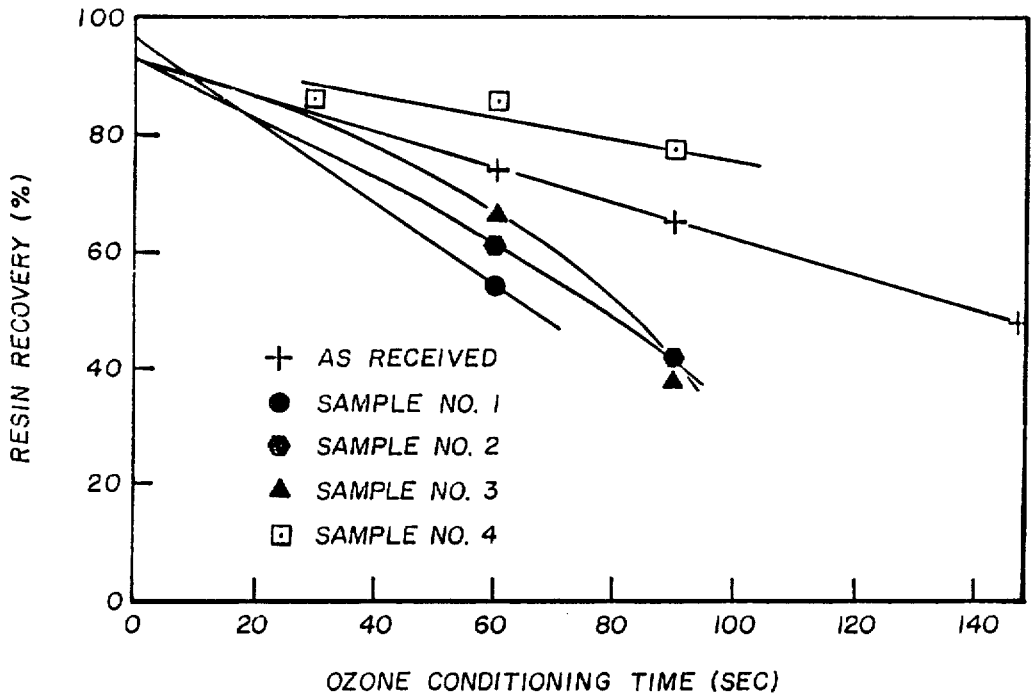

Fig. 1

UNITED STATES PATENT OFFICE

CERTIFICATE OF CORRECTION

Patent No. 4,724,071 Dated February 9, 1988

Inventor(s) Jan D. Miller, Ye Yi

It is certified that error appears in the above-identified patent and that said Letters Patent are hereby corrected as shown below:

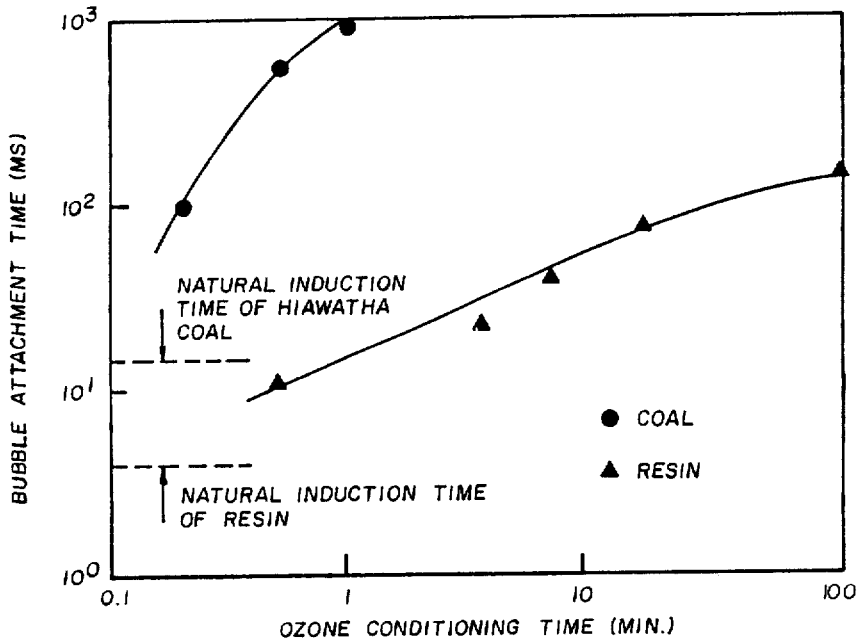

Fig. 2

Signed and Sealed this

Nineteenth Day of July, 1988

Attest:

DONALD J. QUIGG

Attesting Officer

Commissioner of Patents and Trademarks